US005458555A

United States Patent [19]

Ko

[11] Patent Number: 5,458,555

[45] Date of Patent: Oct. 17, 1995

[54] SCISSOR GRIP EXERCISING MACHINE

[76] Inventor: Ching H. Ko, P.O. Box No. 2103, Taichung, Taiwan

[21] Appl. No.: 188,913

[22] Filed: Jan. 31, 1994

[51] Int. Cl.[6] ..... A63B 21/055; A63B 21/04

[52] U.S. Cl. ..... 482/126; 482/129; 482/130; 482/137

[58] Field of Search ..... 482/112, 121–130, 482/133, 135–138

[56] References Cited

U.S. PATENT DOCUMENTS

| | | | |
|---|---|---|---|
| D. 315,936 | 4/1991 | Wilson et al. | 482/129 X |
| 1,680,901 | 8/1928 | Meyer | 482/126 |
| 3,465,750 | 9/1969 | Schawalder | 482/130 X |
| 4,900,015 | 2/1990 | Dissinger | 482/121 X |
| 5,009,416 | 4/1991 | Caruthers | 482/139 |
| 5,246,413 | 9/1993 | Koblick | 482/126 |

FOREIGN PATENT DOCUMENTS

| | | | |
|---|---|---|---|
| 2591496 | 6/1987 | France | 482/127 |
| 1428827 | 11/1968 | Germany | 482/126 |

*Primary Examiner*—Richard J. Apley
*Assistant Examiner*—John Mulcahy
*Attorney, Agent, or Firm*—Morton J. Rosenberg; David I. Klein

[57] ABSTRACT

A scissor grip exercising machine includes a locating bar having a cushion in the middle for supporting the machine on the back of the user between the shoulders. A pair of operating bars are pivotally attached to either end of the locating bar for movement about a pivot axis intermediate their ends. One end of each operating bar terminates in a hand grip. Each operating bar has one through opening on each side of the pivot axis. A pair of elastic reversing members are pivotally attached at one end to the locating bar and at the other end to a selective one of the through openings whereby pivotal movement of the operating bars may be selectively resisted in either direction.

6 Claims, 7 Drawing Sheets

SCISSOR GRIP EXERCISING MACHINE

BACKGROUND OF THE INVENTION

The present invention relates to exercising machines, and more particularly relates to a scissor grip exercising machine for exercising the muscles of the hands and the chest.

A variety of exercising machines have been disclosed for exercising different parts of the body, and have appeared on the market. These exercising machines are commonly bulk and cannot be freely moved from place to place for personal use. Furthermore, these exercising machines are commonly expensive, and therefore they are not popularly accepted.

SUMMARY OF THE INVENTION

One object of the present invention is to provide a scissor grip exercising machine which provides high mobility. Another object of the present invention is to provide a scissor grip exercising machine which is inexpensive to manufacture. According to one embodiment of the present invention, the scissor grip exercising machine is comprised of a locating bar having a cushion in the middle for supporting on the back between the shoulders; two operating bars respectively pivoted to either end of said locating bar by a respective pivot and having a respective front end terminating in a hang grip at right angles; two reversing members being able to return to their former shapes after being pulled, and having a respective front end pivoted to either end of the locating member and a respective rear end pivoted to either operating bar.

DETAILED DESCRIPTION OF THE PREFERRED EMBODIMENT

Figure 1:
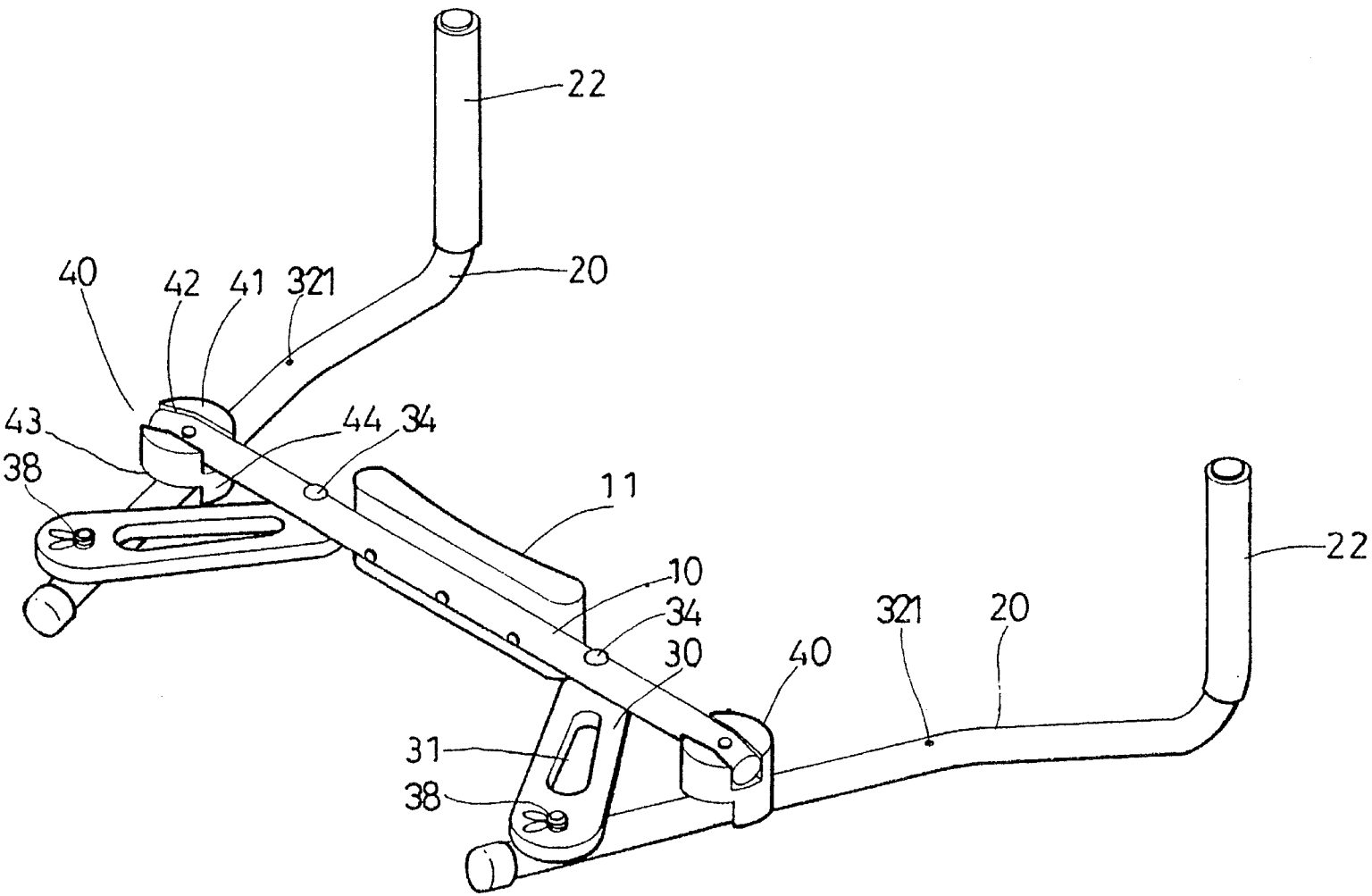
FIG. 1 is an elevational view of a scissor grip exercising machine according to one embodiment of the present invention.
Figure 2:
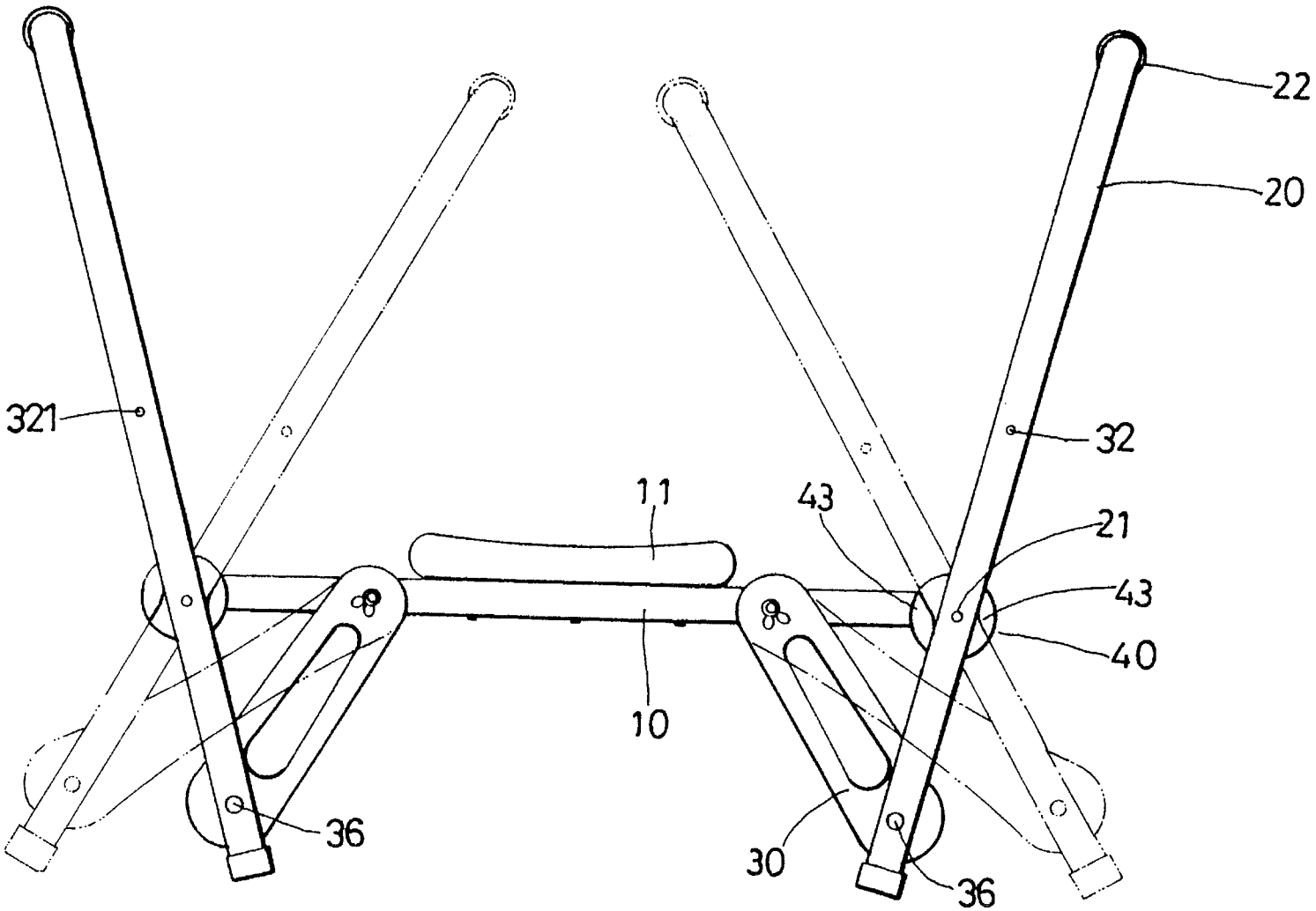
FIG. 2 is a side view of the scissor grip exercising machine shown in FIG. 1, showing the operating bars operated.

Referring to FIGS. 1 and 2, therein shown is a scissor grip exercising machine according to one embodiment of the present invention which is generally comprised of a locating bar 10, two operating bars 20, two reversing members 30, and two cushion blocks 40. The operating bar 20 has a pivot point 21 near its rear end pivoted to either end of the locating bar 10. The distance between the pivot point 21 and the rear end of the operating bar 20 is shorter than that between the pivot point 21 and the front end thereof. The front end of the operating bar 20 is terminating in a vertical hand grip 22.

The reversing member 30 is springy, having one end pivoted to either end of the locating bar 10 at a pivot point 34 and an opposite end pivoted to the rear end of either operating bar 20 at a pivot point 36 by a releasably coupled pivot pin 38. The cushion block 40 is connected between either end of the locating bar 10 and the pivot point 21 of either operating bar 20, having a groove 42 on a bottom surface 41 thereof, which receives either end of the locating bar 10, and two spaced projections 44 raised from a top surface 43 thereof, which are disposed at two opposite sides by either operating bar 20 and have a respective curved inside wall facing the respective operating bar 20. The arrangement of the projections 44 limit the swinging angle of the operating bars 20.

Referring to FIG. 2 again, when in use, the cushion 11 is transversely supported on the back between the shoulders permitting the two operating bars 20 to be disposed in front of the body of the user and the hand grips 22 of the two operating bars 20 to be disposed downward, the user can then hold the hand grips 22 of the two operating bars 20 to perform a scissor action by alternatively pulling the two hand grips 22 toward each other and then releasing them.

In the aforesaid embodiment, the reversing members 30 are respectively made of an oblong rubber plate having an oblong center hole 31. Tensile springs, piston cylinders, or like means may be used to replace the reversing members 30. The groove 42 on either cushion block 40 receives either end of the locating bar 10 and prohibits the locating bar 10 from being turned relative to the respective cushion block 40. The arrangement of the projections 44 limits the swinging angle of the operating bars 20 so that the user's hands will not be jammed during the operation. Alternatively, the cushion blocks 40 may be respectively disposed upside-down for permitting the respective groove 42 to be engaged with either operating bar 20 and the respective projections 44 to be disposed at two opposite sides by either end of the locating bar 10.

Figure 3:
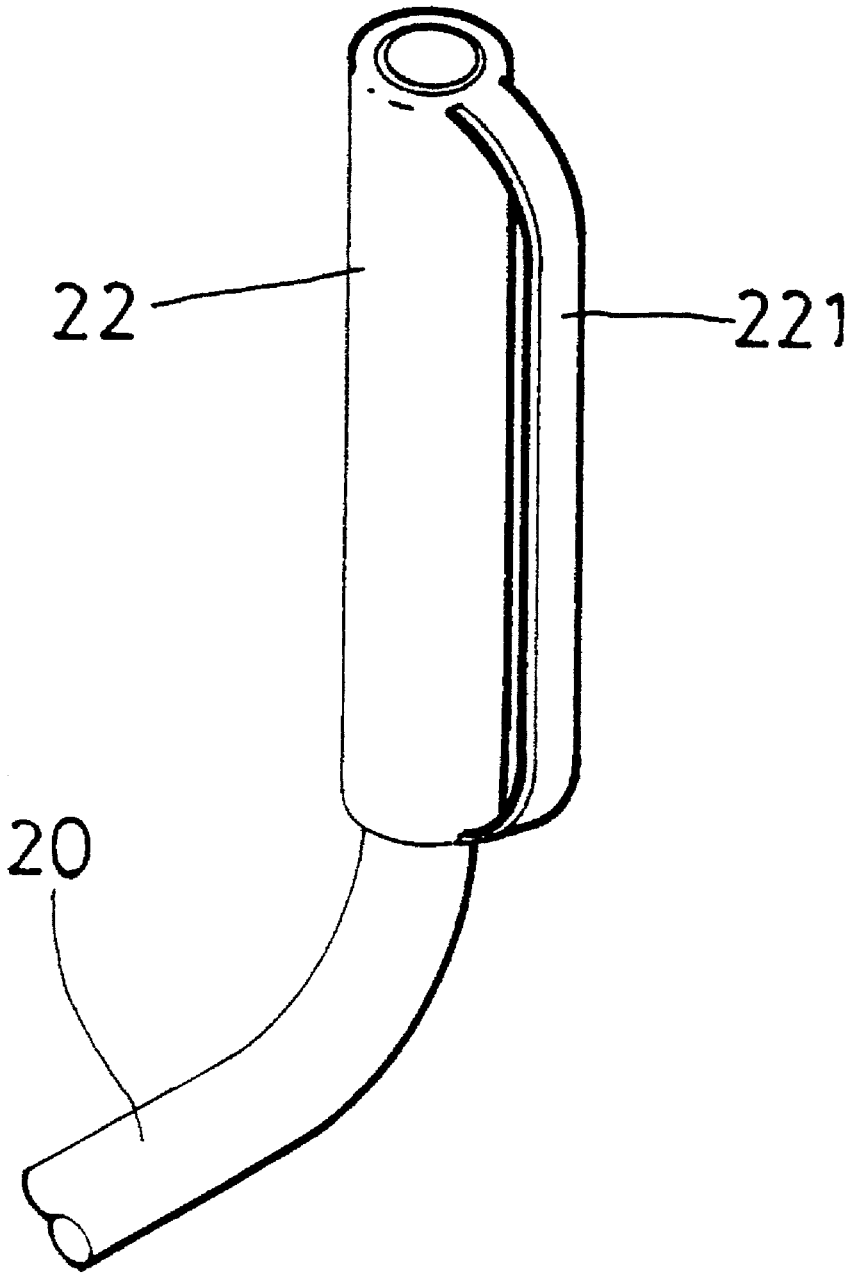
FIG. 3 is an elevational view of a hand grip according to the present invention.

Referring to FIG. 3, a hand guard 221 may be respectively made on the hand grip 22 on each operating bar 20 to protect the hand from being jammed during the scissor action.

Figure 4:
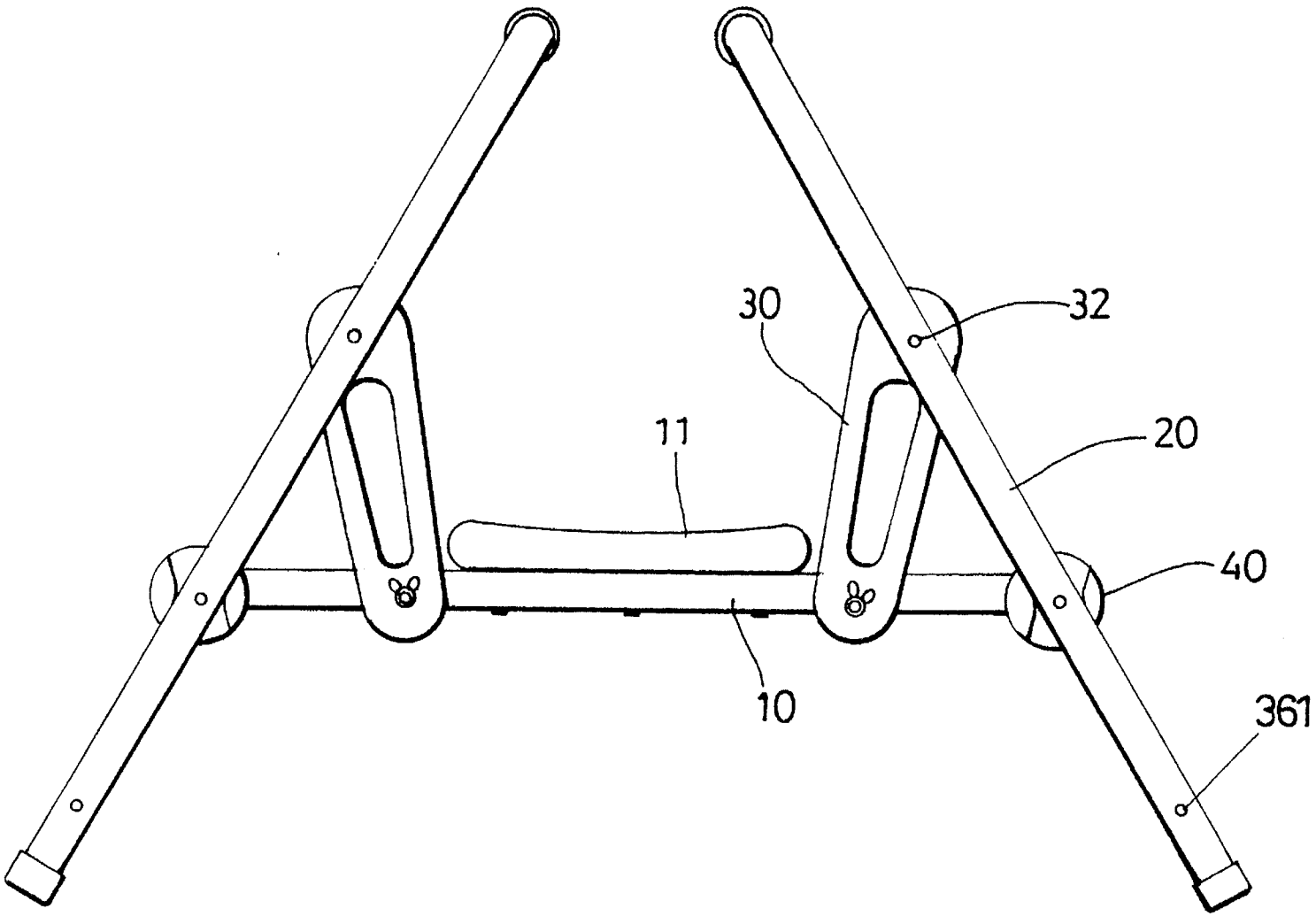
FIG. 4 shows the scissor grip exercising machine of FIG. 1 arranged into an alternative arrangement.

Referring to FIG. 4, there is shown an alternative arrangement of the reversing members 30. As illustrated, the reversing member 30 has one end pivoted to either end of the locating bar 10 at pivot point 34 and an opposite end pivoted to either operating bar 20 at a pivot point 32 near its front end by the releasably coupled pivot pin 38 which is relocated from the through opening 361 to the through opening 321.

Figure 5:
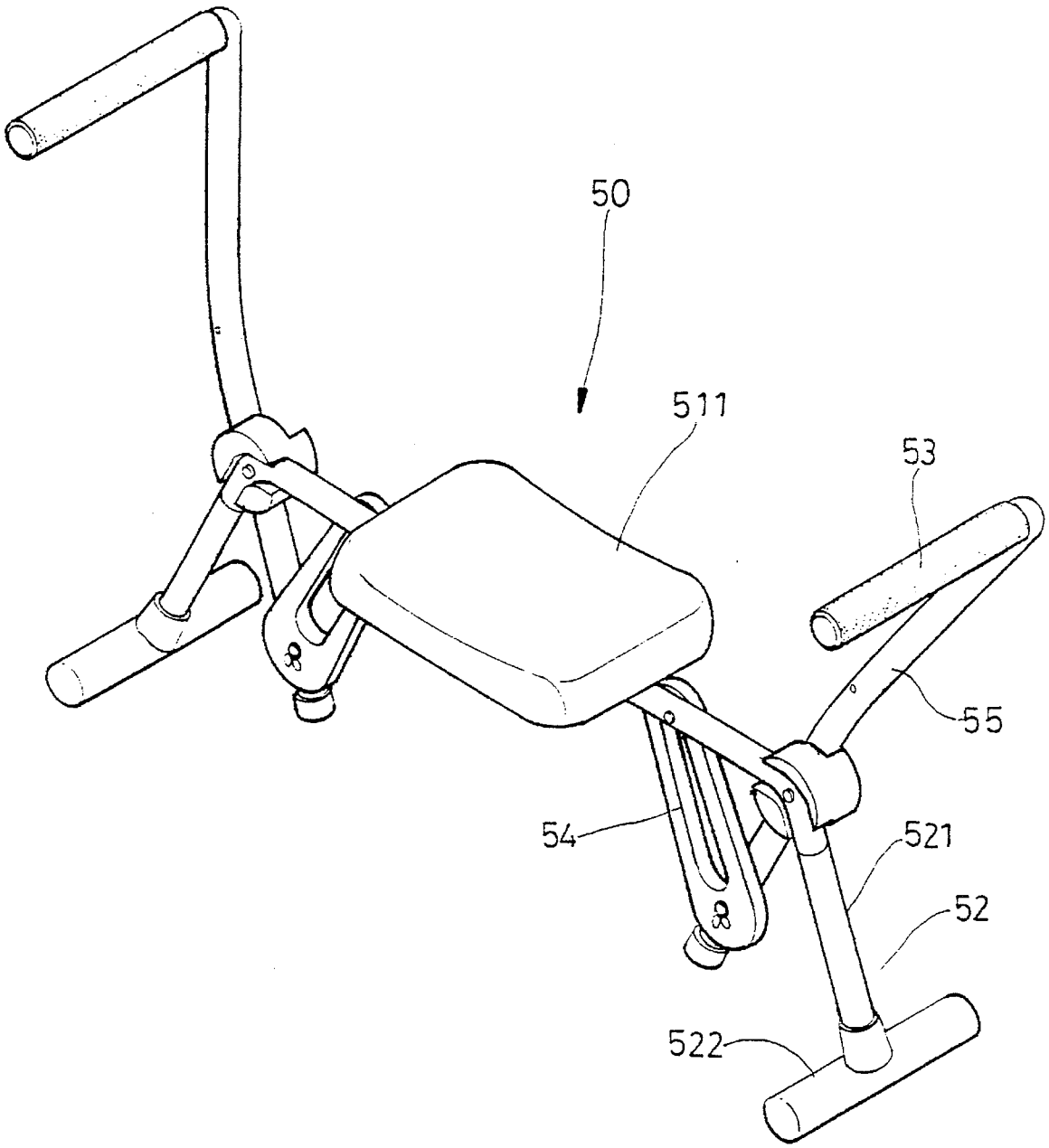
FIG. 5 is an elevational view of a scissor grip exercising machine according to another embodiment of the present invention.
Figure 6:
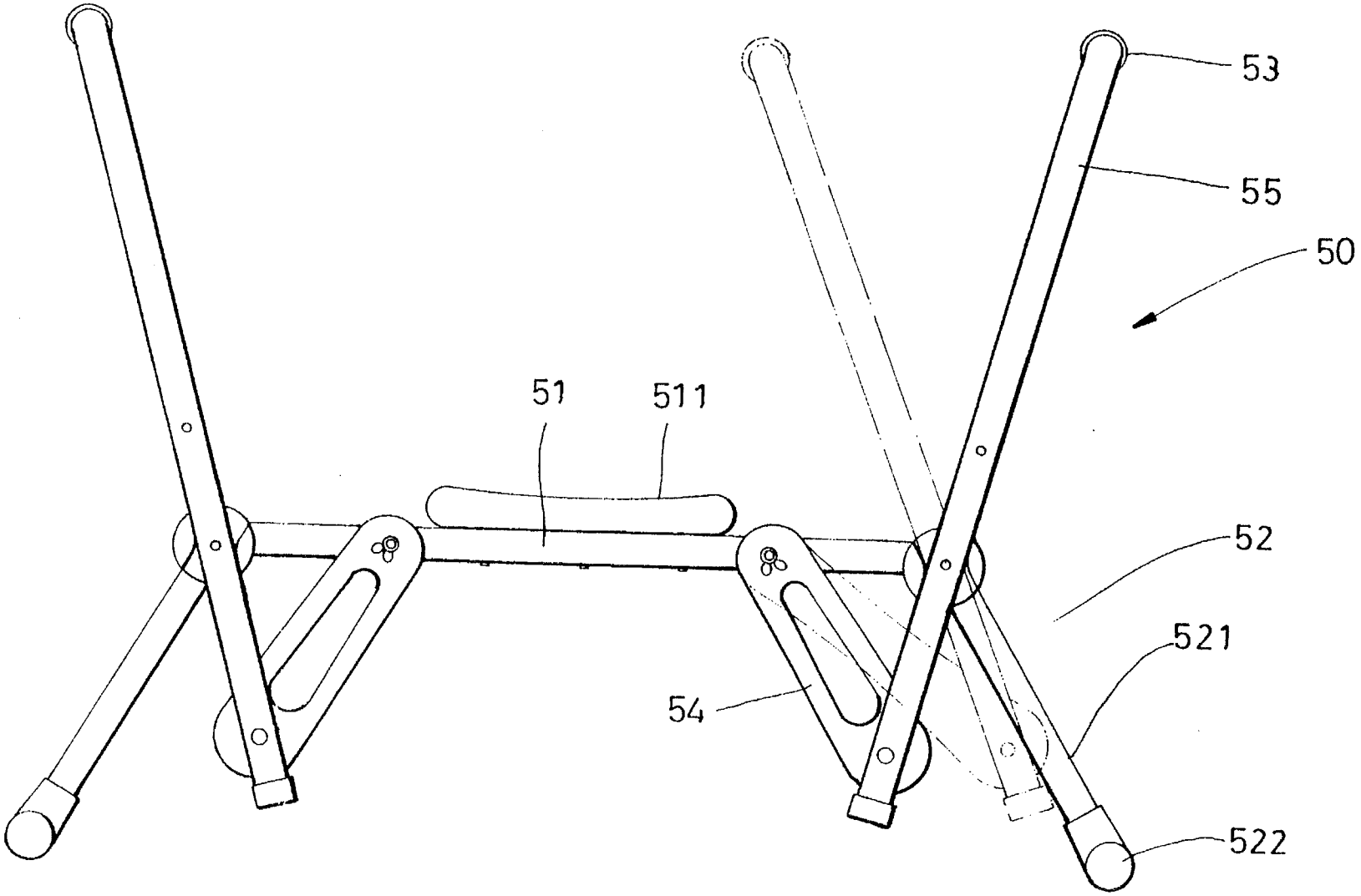
FIG. 6 is a side view of the scissor grip exercising machine shown in FIG. 5, showing the operating bars operated.
Figure 7:
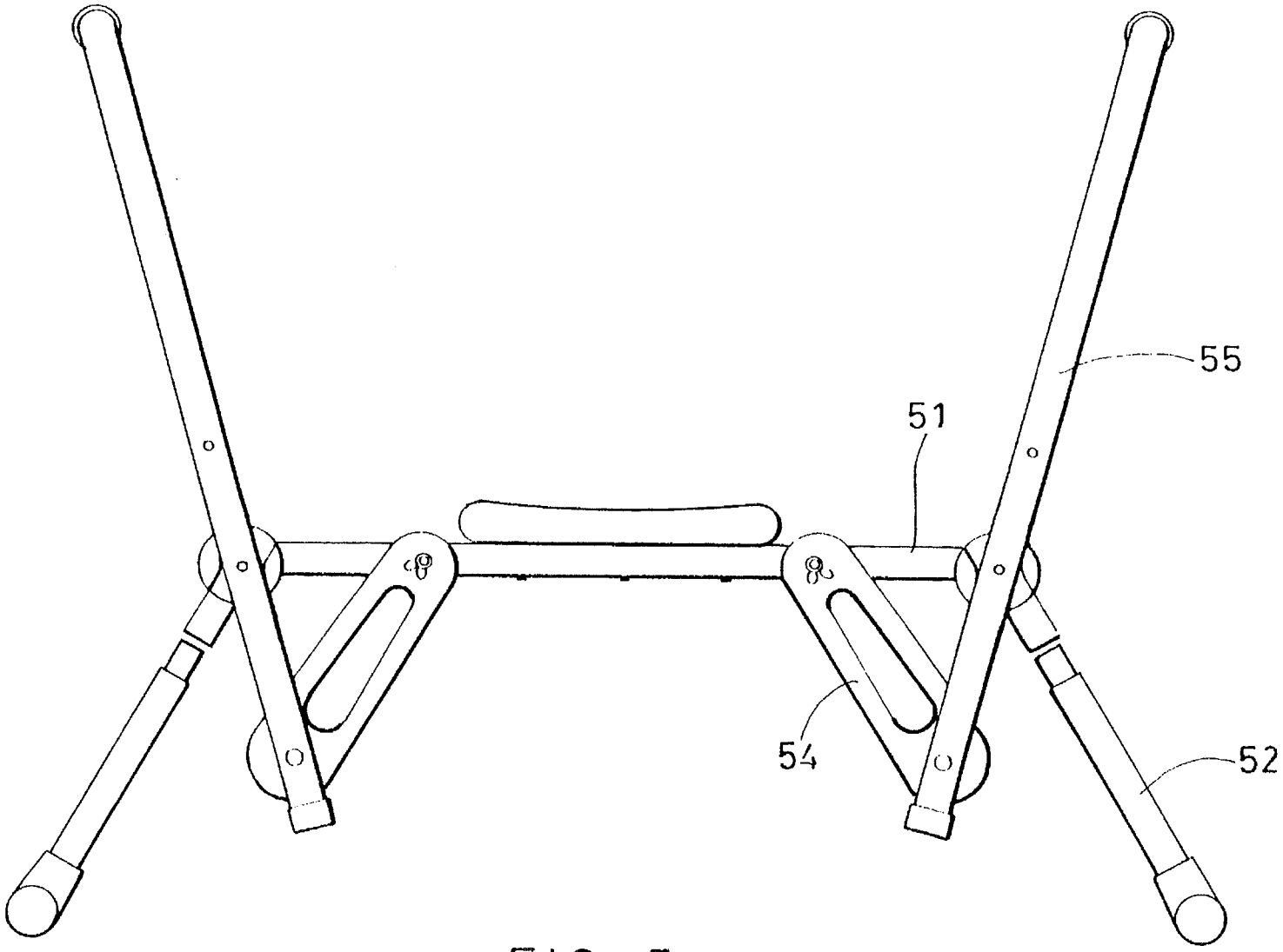
FIG. 7 is another side view of the scissor grip exercising machine shown in FIG. 5, showing the stands detached.

Referring to FIGS. 5 and 6, therein illustrated is an exercising machine according to a second embodiment of the present invention. The exercising machine 50 is comprised of a locating bar 51 having a cushion 511, two operating bars 55 respectively pivoted to either end of the locating bar 51, two reversing members 54 respectively connected between the locating bar 51 and the rear end of either operating bar 55, and two stands 52 respectively connected to either end of the locating bar 51 for supporting the exercising machine 50 on the ground. The stand 52 comprises a horizontal rod 522 at the bottom and a vertical rod 521 perpendicularly extended from the horizontal rod 522 in the middle and connected to either end of the locating bar 51. When assembled, the height of the vertical rod 521 is sufficient for allowing the operating bar 55 to be swung to and fro. When in use, the user sits on the cushion 511 to hold the hand grips 53 of the two operating bars 55, then moves the hand grips 53 toward each other and then release them. When not in use, the stands 52 may be detached from the locating bar 51, as shown in FIG. 7, so as to minimize the storage space.

While only few embodiments of the present invention have been shown and described, it will be understood that various modifications and changes could be made without departing from the spirit and scope of the invention.

What is claimed is:

1. An exercising machine comprising:

a longitudinally extended locating bar having a pair of opposing ends and a cushion secured thereto intermediate said pair of opposing ends;

a pair of operating bars pivotally coupled to said locating bar, each of said pair of operating bars being pivotally coupled to a respective one of said opposing ends of said locating bar at a pivot point, each of said pair of operating bars being defined by an elongate body having a respective front end terminating in a hand grip disposed at a substantially right angle with respect to said elongate body and a respective rear end spaced from said pivot point by a distance less than a distance between said pivot point and said front end of said operating bar, said elongate body of each of said pair of operating bars having a pair of through openings disposed in longitudinally spaced relation on opposing sides of said pivot point;

a pair of cushion blocks coupled to said locating bar, each of said pair of cushion blocks being secured to said locating bar against rotation at said pivotal coupling of a respective one of said operating bars and disposed therebetween; and, two reversing members being able to return to their former shapes after being pulled, each of said reversing members being formed of an oblong rubber plate with a centrally disposed oblong through opening formed therein and having one end pivotally coupled to said locating member adjacent a respective one of said opposing ends thereof, each of said reversing members having an opposing end selectively releasably coupled to one of said pair of through openings of a respective one of said operating bars for providing a resistive force in either of two opposing directions.

2. The exercising machine of claim 1 wherein each cushion block comprises a groove on a bottom surface thereof, which receives either end of said locating bar, and two spaced projections raised from a top surface thereof and disposed at two opposite sides by either operating bar to limit the swinging angle of the respective operating bar.

3. The exercising machine of claim 1 wherein the hand grip of either operating bar is respectively fastened with a hand guard.

4. The exercising machine of claim 1 further comprising two stands respectively fastened to either end of said locating bar for supporting the exercising machine on the ground.

5. The exercising machine of claim 4 wherein each stand is comprised of a horizontal rod at the bottom and a vertical rod perpendicularly extended from said horizontal rod in the middle and connected to either end of said locating bar.

6. The exercising machine of claim 5 wherein said vertical rod is detachably connected to either end of said locating bar.

* * * * *